US007312761B2

(12) United States Patent
Gorai et al.

(10) Patent No.: US 7,312,761 B2
(45) Date of Patent: Dec. 25, 2007

(54) ANTENNA DEVICE MOUNTED ON VEHICLE

(75) Inventors: Tatsuo Gorai, Gunma (JP); Sadao Ohno, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 37 days.

(21) Appl. No.: 11/238,023

(22) Filed: Sep. 29, 2005

(65) Prior Publication Data

US 2006/0071868 A1 Apr. 6, 2006

(30) Foreign Application Priority Data

Oct. 1, 2004 (JP) ..... P2004-289839

(51) Int. Cl.
*H01Q 1/32* (2006.01)

(52) U.S. Cl. ..... 343/715; 343/713

(58) Field of Classification Search ..... 343/715, 343/711, 712, 713, 714
See application file for complete search history.

(56) References Cited

U.S. PATENT DOCUMENTS 3,624,662 A * 11/1971 Feder ..... 343/715
5,032,846 A * 7/1991 Chang ..... 343/882
5,565,877 A * 10/1996 Du et al. ..... 343/715
6,259,411 B1 * 7/2001 Yanagisawa et al. ..... 343/713

FOREIGN PATENT DOCUMENTS

JP 2003-032015 1/2003

* cited by examiner

*Primary Examiner*—Huedung Mancuso
(74) *Attorney, Agent, or Firm*—Morgan, Lewis & Bockius LLP

(57) ABSTRACT

A base member is adapted to be mounted on a vehicle body. A proximal end of a rod-shaped antenna body is pivotably provided on the base member. The antenna body includes an antenna element. A first conductive member is disposed in the base member and provided with a first bracket-shaped portion having elasticity. A second conductive member is electrically connected to the antenna element and provided with a second bracket-shaped portion. The second conductive member is pivotably fitted with the first conductive member while opposite outer faces of the second bracket-shaped portion is brought into elastic contact with opposing inner faces of the first bracket-shaped portion.

5 Claims, 5 Drawing Sheets

ANTENNA DEVICE MOUNTED ON VEHICLE

BACKGROUND OF THE INVENTION

The present invention relates to an antenna device adapted to be mounted on a vehicle body and in which an antenna body is pivotably provided.

FIG. 5 shows an example of this kind of antenna device which is disclosed in Japanese Patent Publication No. 2003-32015A.

A single plate-shaped first feeder plate 14 which is electrically connected to the proximal end of an antenna element 12 is disposed in a proximal end portion of a pivotable antenna body 10. The first feeder plate 14 is conductive and elastic. A single plate-shaped second feeder plate 18 is disposed in a base member 16. The second feeder plate 18 is conductive. A terminal portion 18*a* projecting from the second feeder plate 18 is electrically connected in a proper manner to a circuit board 20 which is provided in the base member 16.

A shaft 22 is made to penetrate through the first and second feeder plates 14 and 18 in a state that they are opposed to each other, whereby the first feeder plate 14 is pivotable with respect to the second feeder plate 18. A coiled spring 24 is inserted to the shaft 22 so that the first feeder plate 14 is kept in elastic contact with the second feeder plate 18. The elastic contact faces of the first and second feeder plates 14 and 18 are formed with a recess and a projection, respectively, that can be rendered in a fitting relationship and thereby constitute a click mechanism.

In the above structure, electrical conduction is established between the proximal end of the antenna element 12 and the circuit board 20 via the first and second feeder plates 14 and 18. Since the recess and projection of the first and second feeder plates 14 and 18 are rendered in a fitting relationship or separated from each other, the antenna body 10 can be pivoted with respect to the base member 16 and fixedly held by the latter in a prescribed posture.

However, the coiled spring 24 is necessary for keeping the first and second feeder plates 14 and 18 in elastic contact with each other and the number of parts is increased accordingly. In addition, assembling work needs to be performed in a state that the coiled spring 24 is compressed and the work is complicated. Further, since elastic contact and electric conduction between the first and second feeder plates 14 and 18 are established by the single pair of faces, the stability of electrical connection is not always satisfactory.

SUMMARY OF THE INVENTION

It is therefore an object of the invention to provide an antenna device for vehicle, that is small in the number of parts and provides stable electrical connection.

In order to achieve the above object, according to the invention, there is provided an antenna device, comprising:

a base member, adapted to be mounted on a vehicle body;

a rod-shaped antenna body, a proximal end of which is pivotably provided on the base member, the antenna body including an antenna element;

a first conductive member, disposed in the base member and comprising a first bracket-shaped portion having elasticity; and a second conductive member, electrically connected to the antenna element and comprising a second bracket-shaped portion, the second conductive member being pivotably fitted with the first conductive member while opposite outer faces of the second bracket-shaped portion is brought into elastic contact with opposing inner faces of the first bracket-shaped portion.

With this configuration, the opposing inner faces of the first bracket-shaped portion are brought by their own elasticity, into elastic contact with the opposite outer faces of the second bracket-shaped portion which is electrically connected to the antenna element. Since no component corresponding to the coiled spring of the conventional structure is necessary, the number of components is reduced accordingly and assembling work is made easier. Further, since the first conductive member is brought into elastic contact with the second conductive member, electrical conduction is established through the two sets of faces and hence the electrical connection is made more stable.

The antenna device may further comprise a shaft penetrating the first conductive member and the second conductive member, so that the second conductive member is pivotable about the shaft. In this case, the structure allowing the second conductive member to be pivoted can be made simple.

One of each of the opposing inner faces of the first bracket-shaped portion and each of the opposite outer faces of the second bracket-shaped portion may be formed with a projection, and the other one may be formed with a recess adapted to be fitted with each other to constitute a click mechanism.

In this case, the antenna body can be pivoted relative to the first conductive member and retained in a prescribed posture without increasing the number of component.

Here, the projection and the recess may have such sizes that the projection is partly fitted into the recess.

In this case, the elasticity of the first conductive member concentrates on the projections and the recesses so that the projections are brought into contact with the recesses with great elasticity. Accordingly, reliable electrical connection is established.

In a case where each of the opposing inner faces of the first bracket-shaped portion may be formed with the recess and each of the opposite outer faces of the second bracket-shaped portion may be formed with the projection, each of the opposing inner faces of the first bracket portion may be formed with a groove communicating the recess with an edge of an associated one of the opposing inner faces.

In this case, the projections of the second conductive member can easily be guided, by way of the grooves, to the positions where they fit into the recesses, respectively.

BRIEF DESCRIPTION OF THE INVENTION

The above objects and advantages of the present invention will become more apparent by describing in detail preferred exemplary embodiments thereof with reference to the accompanying drawings, wherein.

DETAILED DESCRIPTION OF THE EMBODIMENTS

Figure 1:
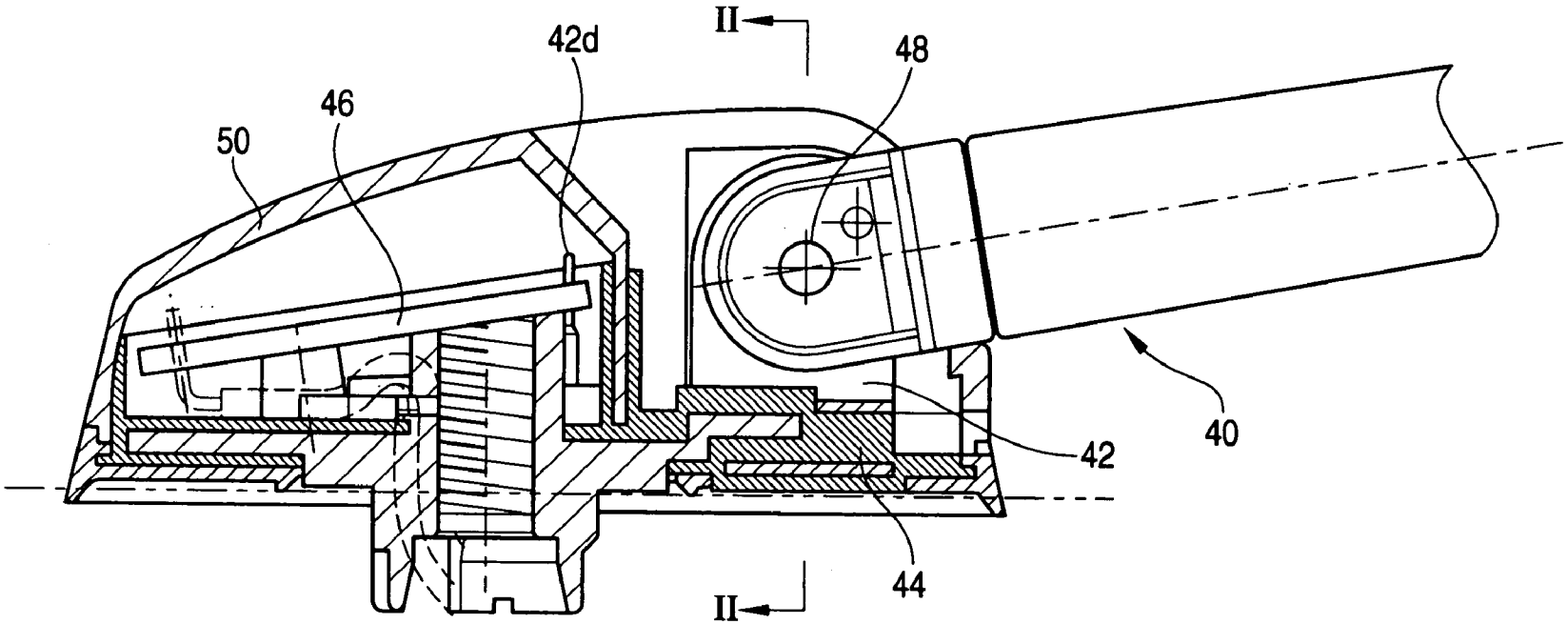
FIG. 1 is a section view of an antenna device according to one embodiment of the invention.

Embodiments of the invention will be described below in detail with reference to the accompanying drawings.

In an antenna device according to one embodiment of the invention, the proximal end of an antenna element 30 is screwed into an insertion fitting 32 which is conductive. A bracket-shaped pivot plate 34 is fixed to the insertion fitting 32 by caulking with its opening down and electrical conduction is thereby established between them. A resin mold 36 is formed with the insertion fitting 32 and the pivot plate 34 inserted therein. Both side walls of the bracket-shaped pivot plate 34 are exposed and serve as outer walls of the resin mold 36. Part of the resin mold 36 and the antenna element 30 are covered with a cover 38 made of an insulative resin, whereby a pivotable antenna body 40 is formed.

Figure 4C:
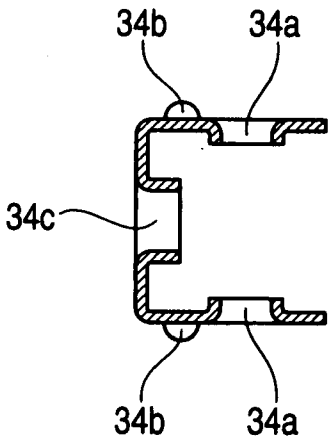
FIG. 4C is a section view taken along a line IVC-IVC in FIG. 4A.
Figure 4A:
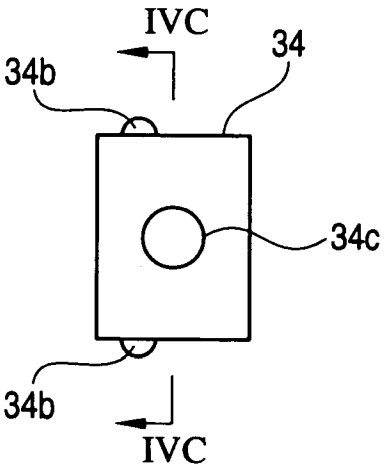
FIG. 4A is a top view of a pivot plate in the antenna device of FIG. 1.
Figure 4B:
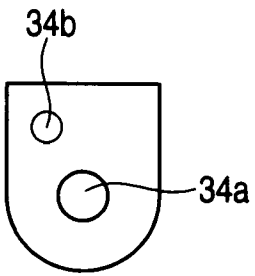
FIG. 4B is a side view of the pivot plate.
Figure 5:
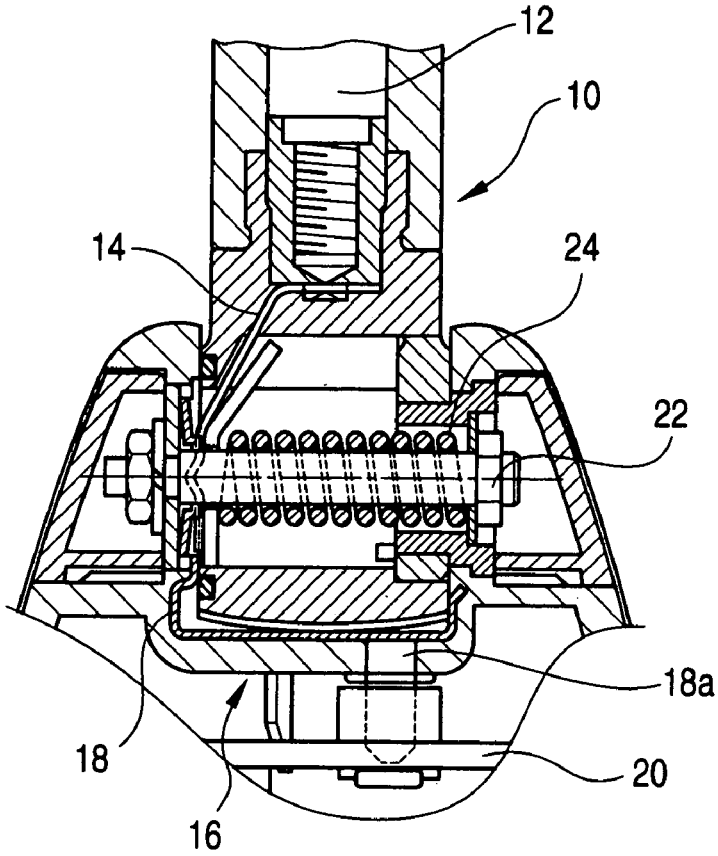
FIG. 5 PRIOR ART
FIG. 5 is a section view of a conventional antenna device.

As shown in FIG. 4 in detail, the pivot plate 34 is formed as follows. A bracket-shaped part is formed by working on a conductive metal sheet. Holes 34*a* for shaft insertion are formed through the two respective side walls of the bracket-shaped part, and projections 34*b* project outward from the two respective side walls. A caulking hole 34*c* for fixing to the insertion fitting 32 is formed through the connecting wall of the bracket-shaped part.

A base member 44 is molded out of an insulative resin with a base plate 42 inserted therein. As described in FIG. 3 in detail, the base plate 42 is formed by working on a conductive and elastic metal sheet of stainless steel or the like so as to have a bracket-shaped cross section. Holes 42*a* for shaft insertion are formed through the two respective side walls of the bracket-shaped part, and plural (in this embodiment, three) holes 42*b* (or recesses) are formed on a circle that is centered by each of the holes 42*a*. The inner face of each of the two side walls of the bracket-shaped part is formed with a groove 42*c* that communicates with the outer periphery and one of the holes 42*b*. A terminal portion 42*d* projects from the connecting wall of the bracket-shaped part. The terminal portion 42*d* is disposed in the base member 44 so as to project properly in an accommodation place of a circuit board 46 which is provided in the base member 44 as shown in FIG. 1.

The pivot plate 34 of the pivotable antenna body 40 is inserted into the bracket-shaped part of the base plate 42 of the base member 44, the holes 34*a* and 42*a* for shaft insertion are registered with each other, and a shaft 48 is inserted through those holes 34*a* and 42*a*. As a result, the pivotable antenna body 40 is made pivotable with respect to the base member 44. Further, a case 50 is placed so as to cover the base member 44. The case 50 restricts the shaft 48 properly so that the shaft 48 does not come off. It goes without saying that the projections 34*b* of the pivot plate 34 are located at such positions as to be able to be opposed to and fitted into the pair of holes 42*b* of the base plate 42.

Figure 2B:
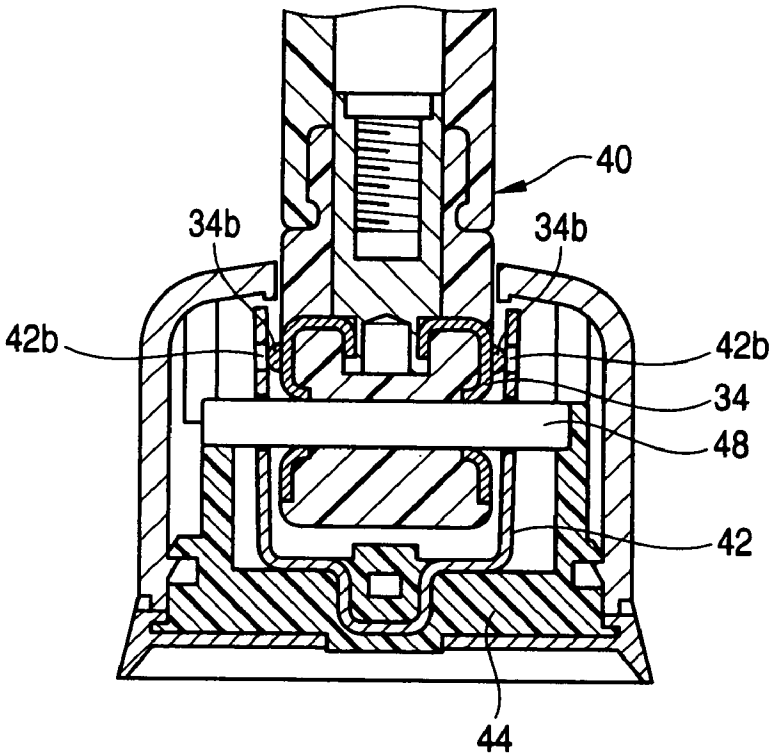
FIG. 2B is a section view taken along a line II-II in FIG. 1, showing a state that the pivotable antenna body is held in another prescribed angle.

With the above configuration, if an attempt to pivot the pivotable antenna body 40 is made by a force that is stronger than a prescribed level, as shown in FIG. 2B, the opening dimension of the bracket-shaped part of the base plate 42 is increased because of its elastic deformation, and the projections 34*b* of the pivot plate 34 escape from the pair of holes 42*b* of the base plate 42. The pivotable antenna body 40 is rendered pivotable.

Figure 2A:
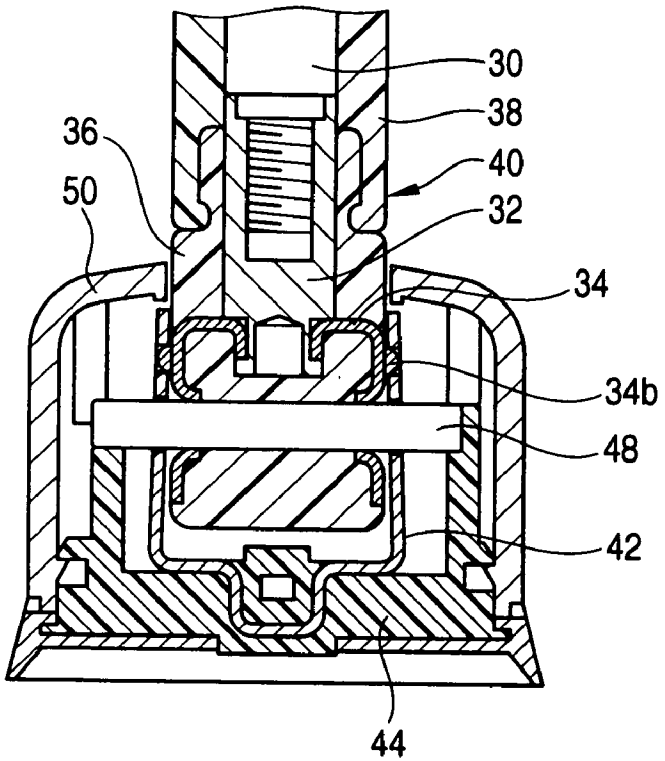
FIG. 2A is a section view taken along a line II-II in FIG. 1, showing a state that a pivotable antenna body in the antenna device is held in a prescribed angle.
Figure 3A:
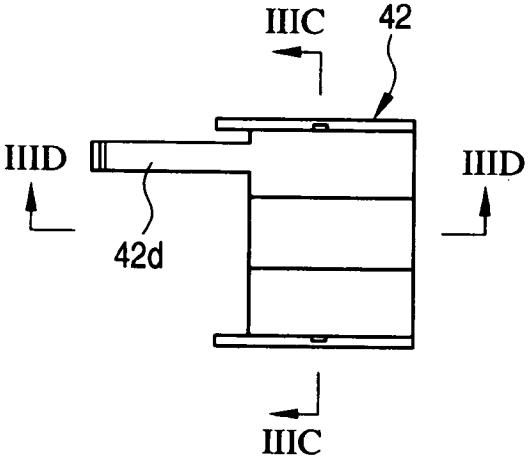
FIG. 3A is a top view of a base plate in the antenna device of FIG. 1.
Figure 3B:
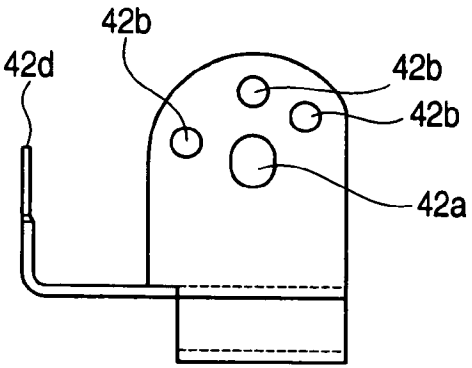
FIG. 3B is a side view of the base plate.
Figure 3C:
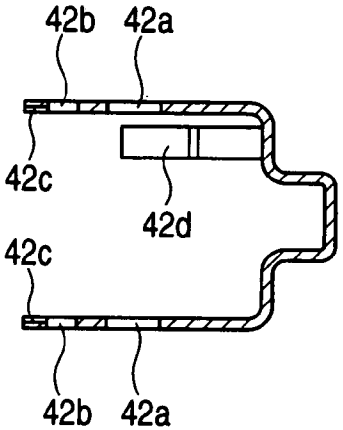
FIG. 3C is a section view taken along a line IIIC-IIIC in FIG. 3A.
Figure 3D:
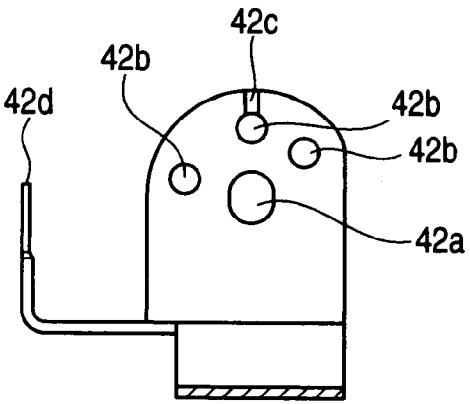
FIG. 3D is a section view taken along a line IIID-IIID in FIG. 3A.

When the projections 34*b* of the pivot plate 34 are located at such positions as to be opposed to the pair of holes 42*b* of the base plate 42, the opening dimension of the bracket-shaped part of the base plate 42 is made small because of its own elastic deformation, whereby the projections 34*b* are inserted (fitted) in the respective holes 42*b*. As shown in FIG. 2A, the pivotable antenna body 40 is fixed (i.e., its posture is maintained) as long as a force for pivoting the pivotable antenna body 40 is weaker than the prescribed level.

In this manner, the projections 34*b* and the holes 42*b* serve as a click mechanism. If the dimensions of the holes 42*b* and the projections 34*b* are set so that the projections 34*b* cannot be fully inserted into the holes 42*b* (i.e., insertion of the projections 34*b* is disabled halfway and their fitting is completed in this state), the elasticity of the base plate 42 concentrates on the fitting portions and the pivot plate 34 can be brought into contact with the base plate 42 with great elasticity. Reliable electrical connection is thereby established.

Since the pivot plate 34 is attached to the base plate 42 in such a manner that the projections 34*b* reach the holes 42*b* passing through the grooves 42*c*, the pivot plate 34 can be attached without elastically deforming the opening portion of the bracket-shaped part of the base plate 42 unduly.

In this embodiment, the dimensions of the holes 42*b* and the projections 34*b* are set so that the projections 34*b* cannot be fully inserted into the holes 42*b* (i.e., insertion of the projections 34*b* is disabled halfway and their fitting is completed in this state). However, the projections 34*b* may be fully inserted into the holes 42*b*, in which case the two inner faces of the base plate 42 are brought into elastic contact with the respective side faces of the pivot plate 34.

In this embodiment, the pivotable structure is realized by letting the shaft 48 penetrate through the base plate 42 and the pivot plate 34. However, screws or the like serving as shafts may be inserted from both sides. Alternatively, instead of the holes 42*a* and 34*a* for shaft insertion, the base plate 42 and the pivot plate 34 may be formed with circular recesses and projections (the latter can be fitted into the former) capable of operating equivalently to a shaft.

In this embodiment, the holes 42*b* of the base plate 42 and the projections 34*b* of the pivot plate 34 constitute the click mechanism. However, the base plate 42 may be formed with projections and the pivot plate 34 may be formed with holes (or recesses). Alternatively, the click mechanism is not necessarily provided in the elastic contact faces of the base plate 42 and the pivot plate 34. For example, a click mechanism may be realized in such a manner that balls urged by springs are provided in elastic contact with recesses formed in the resin mold 36 of the pivotable antenna body 40 so that the balls can be fitted into and separated from them. It would be understood easily that the click mechanism may have any structure. The postures in which the pivotable antenna body 40 is held by the click mechanism be set as appropriate, such as a horizontal posture and postures with elevation angles of 60 and 90 degrees.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An antenna device, comprising:

a base member, adapted to be mounted on a vehicle body;

a rod-shaped antenna body, a proximal end of which is pivotably provided on the base member, the antenna body including an antenna element;

a first conductive member, disposed in the base member and comprising a first bracket-shaped portion having elasticity; and a second conductive member, electrically connected to the antenna element and comprising a second bracket-shaped portion, the second conductive member being pivotably fitted with the first conductive member while opposite outer faces of the second bracket-shaped portion is brought into elastic contact with opposing inner faces of the first bracket-shaped portion.

2. The antenna device as set forth in claim 1, further comprising a shaft penetrating the first conductive member and the second conductive member, so that the second conductive member is pivotable about the shaft.

3. The antenna device as set forth in claim 1, wherein one of each of the opposing inner faces of the first bracket-shaped portion and each of the opposite outer faces of the second bracket-shaped portion is formed with a projection, and the other one is formed with a recess adapted to be fitted with each other to constitute a click mechanism.

4. The antenna device as set forth in claim 3, wherein the projection and the recess have such sizes that the projection is partly fitted into the recess.

5. The antenna device as set forth in claim 3, wherein:

each of the opposing inner faces of the first bracket-shaped portion is formed with the recess and each of the opposite outer faces of the second bracket-shaped portion is formed with the projection; and each of the opposing inner faces of the first bracket portion is formed with a groove communicating the recess with an edge of an associated one of the opposing inner faces.

* * * * *